United States Patent [19]

Taki

[11] Patent Number: 4,997,492

[45] Date of Patent: Mar. 5, 1991

[54] METHOD OF PRODUCING ANODE MATERIALS FOR ELECTROLYTIC USES

[75] Inventor: Kazuhiro Taki, Kanagawa, Japan

[73] Assignee: Nippon Mining Co., Ltd., Tokyo, Japan

[21] Appl. No.: 535,272

[22] Filed: Jun. 8, 1990

[51] Int. Cl.[5] ..... C22F 1/18; C22C 14/00; C25B 11/04

[52] U.S. Cl. ..... 148/11.5 R; 148/11.5 F; 148/421; 204/105 M; 204/293

[58] Field of Search ..... 148/11.5 R, 11.5 F, 148/421, 902; 204/293, 105 M

[56] References Cited

U.S. PATENT DOCUMENTS

| | | | |
|---|---|---|---|
| 2,608,531 | 8/1952 | Fox | 204/105 M |
| 3,033,775 | 5/1962 | Chevigny et al. | 204/293 |
| 3,169,085 | 2/1965 | Newman | 148/11.5 F |
| 3,957,600 | 8/1976 | Ives et al. | 204/293 |
| 4,363,706 | 12/1982 | Williams et al. | 204/293 |
| 4,663,010 | 5/1987 | Debrodt et al. | 204/293 |
| 4,744,878 | 5/1988 | Riggs, Jr. | 204/293 |

FOREIGN PATENT DOCUMENTS

| | | | |
|---|---|---|---|
| 1-165785 | 6/1989 | Japan . | |
| 1-176085 | 7/1989 | Japan . | |
| 1-294836 | 11/1989 | Japan . | |
| 1076496 | 2/1984 | U.S.S.R. | 204/293 |

OTHER PUBLICATIONS

*Constitution of Binary Alloys,* Max Hansen and Kurt Anderko, McGraw-Hill Book Company, 1958, pp. 1050 and 1051.

*Primary Examiner*—R. Dean
*Assistant Examiner*—Robert R. Koehler
*Attorney, Agent, or Firm*—Seidel, Gonda, Lavorgna & Monaco

[57] ABSTRACT

A method of producing an anode material for electrolytic use comprises heat-treating a titanium alloy which consists of 0.1-10 wt % of nickel and the remainder of titanium and unavoidable impurities and which has been thermally affected above its beta transformation point, at a temperature of 400°-800° C. during the process. Alternatively, the alloy is cold-rolled to a working degree of at least 10 percent prior to the heat treatment. The anode material is made to have a surface roughness, Rmax, of at least 100 μm, a yield strength of at least 30 kgf/mm$^2$, a Vickers hardness of at least 150, and a flatness of at most 6 mm per meter.

8 Claims, No Drawings

METHOD OF PRODUCING ANODE MATERIALS FOR ELECTROLYTIC USES

BACKGROUND OF THE INVENTION

This invention relates to a method of producing anode materials for use in electrolysis of various aqueous solutions.

Aqueous solution electrolysis, e.g., electrolytic winning of a non-ferrous metal such as Zn, Cd, Cr, Co, Mn, Cu, and Ni, normally uses a lead alloy, graphite, platinum-plated or platinum-Clad titanium as an insoluble anode material. Insoluble anodes are also used frequently in electroplating, another variation of aqueous electrolysis.

However, the insoluble anode materials that perform fully satisfactorily in electrowinning or electroplating are but few because of various shortcomings.

Where the electrolyte is a sulfuric acid-sulfate solution, e.g., a lead alloy is often used as an insoluble anode. The lead alloy anode releases lead ions dissolving out in trace amounts, and the accumulation of such ions causes the resulting electrodeposit to contain lead which, in turn, gives various unfavorable effects, as is well known in the art.

When the insoluble anode adopted is graphite, it is rapidly consumed due to the breaking down and falling into the electrolyte on account of the oxidation or brittleness of graphite. Thus the life of graphite is short, and the graphite dust falling off can produce contamination of the electrolyte and many other deleterious effects.

Platinum plating or cladding is costly, and platinum is soft enough to be worn with sludge or the like in the electrolyte. The wear combines with electrolytic dissolution to cause early consumption and hence shorter life than expected.

The use of titanium superior in both specific strength and corrosion resistance as an electrode base for insoluble anodes results in the formation of a thick passive film over the titanium surface. This raises the bath voltage until the flow of current becomes totally impossible.

Titanium may occasionally be chosen as an anode where the current density is low. Typical of such unusual cases is the manufacture of electrolytic manganese dioxide, in which pure titanium is an almost exclusive material for the anode at present.

Electrolytic manganese dioxide is used chiefly as the active material of dry cells. It is usually manufactured by electrolysis from an aqueous sulfuric acid-manganese sulfate solution containing from 0.5 to 1.0 mole manganese sulfate and from 0.2 to 0.6 mole free sulfuric acid per liter of the solution.

The aqueous solution upon electrolysis with a direct current on the order of 0.8 $A/dm^2$ deposits manganese dioxide on the anode. At the stage the deposit has grown enough to a certain extent, it is peeled off and collected as product manganese dioxide. During the process, hydrogen evolves from the cathode.

Titanium has recently come into use as the anode material for the manufacture of electrolytic manganese dioxide. The titanium electrode has such outstanding corrosion resistance, specific strength, and workability that it precludes anode-induced contamination of electrolytic manganese dioxide and yields a quality product.

One problem associated with the use of titanium as the anode for the above process has been the growth of the passive state film on the surface with the increase in current density; it raises the bath voltage accordingly, until the flow of current becomes no longer possible. To overcome the problem it has been necessary to keep the current density within the range around 0.8 $A/dm^2$ Current density thus has a direct bearing upon productivity in the electrolysis industry. The electrolytic cell employed being the same, the higher the current density the larger would be the scale of production that is made feasible. Also, the output being the same, the electrolytic cell could be made smaller in size as the current density increases, reducing the investment in the electrolytic cell to an economical advantage.

Titanium is used as anodes not merely for the production of electrolytic manganese dioxide but also for other applications. With the latter too the difficulty is that increased current density induces the growth of passive state film on the surface with eventual interruption of current flow. To avoid this, modern practice favors plating of the anodes with the noble metal such as platinum.

However, the treatment using an expensive noble metal casts a heavy financial burden on the manufacturer. It thus presents a major obstacle in the way of the extensive commercial acceptance of the plated anodes.

With these in view, this invention is aimed at providing a method of producing titanium alloy anodes which can carry more current at higher density than conventional titanium anodes can.

SUMMARY OF THE INVENTION

In an intensive effort to overcome the problems of the prior art, we have found that an anode made of a titanium-base alloy containing nickel, with $Ti_2Ni$ particles precipitated and dispersed uniformly and finely throughout, is capable of bearing a high current density, and we have made further studies to establish its convenient manufacturing method. Titanium-nickel alloy anodes are made by first melting the component metals into an ingot and hot working the ingot in various ways to obtain the objective anode material. The hot working always involves heating above the beta transformation point, thus forming a solid solution of Ni in Ti and as such the dispersion of Tihd 2Ni as desired cannot take place.

We have now successfully realized fine, homogeneous dispersion of a $Ti_2Ni$ precipitates by heat treatment in a specific temperature range and also by a combination of cold working and heat treatment under specific conditions.

On the basis of these findings, the present invention provides:

(1) a method of producing an anode material for electrolytic use characterized by heat-treating a titanium alloy which consists of from 0.1 to 10 percent by weight of nickel and the remainder of titanium and unavoidable impurities and which has been thermally affected above the beta transformation point thereof, at a temperature between 400° and 800° C.; and (2) a method of producing an anode material for electrolytic use characterized by cold working a titanium alloy which consists of from 0.1 to 10 percent by weight of nickel and the remainder of titanium and unavoidable impurities and which has been thermally affected above the beta transformation point thereof, to a working degree of 10 percent and subsequently heat-treating it at a temperature between 400° and 800° C.

The anode materials according to the invention are desired to be finished to impart the following properties:

(a) a surface roughness, Rmax, of 100 μm or above;

(b) a yield strength of 30 kgf/mm$^2$ or above and a Vickers hardness of 150 or above; and (c) a flatness of 6 mm or less per meter.

DETAILED DESCRIPTION OF THE INVENTION

The titanium anode used in the present invention features the addition of nickel to titanium which aimed at forming an intermetallic compound $Ti_2Ni$ by reaction between titanium and nickel $Ti_2Ni$ is highly corrosion-resistant (superior in this respect to pure titanium) and, unlike pure titanium, it causes no bath voltage rise due to the formation of an oxide film with the flow of a large current. Thus we have found that it can carry much current without the danger of corrosion even in quite adverse, corrosive environments. In spite of this, $Ti_2Ni$ is so brittle that when used alone it cannot practically serve as an electrode for industrial applications. We have now succeeded in overcoming the brittleness of the compound by adding nickel to titanium and dispersing $Ti_2Ni$ very finely and homogeneously into titanium. In this way a method has now been perfected for producing an anode which permits the flow of far more current than pure titanium does.

It should be noted that if the nickel concentration is less than 0.1 percent the amount of $Ti_2Ni$ deposited will be too small to achieve an appreciable effect. Conversely if the concentration exceeds 10 percent, seriously low workability will result. Even when the nickel concentration is within the range of 0.1 to 10 percent, another requirement must be met. During ingot making and in subsequent forging, hot working, and the like, the material is necessarily heated in the beta temperature region. In that region nickel in the specified range of proportion is always in the form of solid solution with titanium, and the objective $Ti_2Ni$ does not emerge. It has now been found that a very fine, homogeneously dispersed $Ti_2Ni$ precipitation can be obtained by heat treatment of a Ni-Ti alloy member preheated above the beta trans-formation point, at a temperature between 400° and 800° C. The discovery has led to the present invention. It has also been found that for more effective precipitation of $Ti_2Ni$ it is beneficial to give strain to the alloy by cold working and then carry out the heat treatment between 400° and 800° C. The discovery forms another basis of the invention. The degree of working is specified to be 10 percent or more, because with a lower degree the step of cold working produces almost no favorable effect.

For the better understanding of the invention the following may be added for reference. Generally, there are three intermetallic compounds of titanium and nickel: $Ti_2Ni$, TiNi, and $TiNi_3$. With these compounds it has been found that no increase in bath voltage is observed when current is flown through each as an anode. Since an insoluble anode is also required to dissolve out no component metal into the bath, the compounds were all tested with various solutions for corrosion and positive polarization behavior. The results showed that, among $Ti_2Ni$, TiNi, and $TiNi_3$, the first-mentioned $Ti_2Ni$ performed best. Even in strongly acidic aqueous solutions $Ti_2Ni$ alone permitted the flow of high density current without any component metal dissolution up to the oxygen-generating potential.

Thus, $Ti_2Ni$ has proved to possess very desirable properties as an insoluble anode. However, it is too brittle an intermetallic compound for the manufacture of the anode. Another disadvantage is that in environments where oxygen, chlorine, and other gases are produced by long-period electrolysis, the impact of gas evolution causes the $Ti_2Ni$ to come off. Our further research has revealed that when Ti and $Ti_2Ni$ are allowed to coexist Ti makes up for the brittleness of the compound and keeps the latter from falling off. There is no danger of titanium dissolving out, because a passive state film is formed on its surface, enabling the remaining $Ti_2Ni$ surface to function well as an insoluble anode. If the $Ti_2Ni$ proportion is too small a high current density is not attained; hence the lower limit is specified for Ni.

In connection with the manganese dioxide-producing anode, it has been found that while it is essential that electrolytic manganese dioxide deposit on the surface during the course of electrolysis, the electrolytically deposited manganese dioxide comes off ordinary rolled sheets. It has also been found that the exfoliation can be avoided by finishing the surface to a roughness, Rmax, of at least 200 μm. The electrolytic manganese dioxide that has deposited after the electrolysis must be removed, e.g., by hammering of the anode for mechanical stripping. This can cause bending or denting of the anode due to insufficient strength or hardness. It is desirable for this reason that the anode have a yield strength of 30 kgf/mm$^2$ or more and a Vickers hardness of 150 or more.

The anode for manganese dioxide production usually must be spaced a certain distance from the cathode. If it is warped or curled, the growth of electrolytic manganese dioxide varies with the location of the anode surface; in an extreme case, shorting can occur. For this reason it is recommended to restrict the warping or curling to a flatness of 6 mm or less per meter.

In preferred embodiments of the invention $Ti_2Ni$ is deposited under specific conditions.

The $Ti_2Ni$ particles on the anode surface are desired to be at most 300 μm in diameter, because larger particles will fall off the anode surface during actual operation. Also, uniform dispersion of the $Ti_2Ni$ particles is an essential requirement. If the dispersion is ununiform, uneven current flow will result from the irregular distribution of the particles on the anode surface, leading to an ununiform manganese dioxide growth rate. In order to attain a sufficiently high current density, it is desirable that the $Ti_2Ni$ particles be present at the rate of 10,000 or more per square millimeter of the base surface.

The invention is illustrated by the following examples.

EXAMPLES

Pure nickel was added in varying proportions to commercially available sponge titanium, and ingots were made by vacuum melting. They were heated to 900° C. and hot forged, and once again heated to that temperature and forged into 5 mm-thick sheets. They were further processed, by heat treatment at 400° to 800° C. or at other temperature or by cold rolling for straining followed by heat treatment, to obtain test specimens for evaluation testing.

The evaluation method used was as follows. Galvanostatic electrolysis was carried out in the same solution as used in actual operation so as to form a manganese dioxide deposit on the surface of each test specimen. The bath voltage rise during the process was observed to find up to what current density the specimen could stand. The criterion adopted was: When it took more than 100 hours before the bath voltage exceeded 7 V, it was considered that manganese dioxide could be made without difficulty at that current density.

Table 1 shows that at current densities of 1.2 A/dm$^2$ and above, pure titanium and an alloy with a nickel concentration of less than 0.1 percent caused the rise of bath voltage within 50 hours, while the alloys containing nickel within the specified range did not. Thus it should be clear that the anodes made by the method of the invention can carry more current. Examples given here demonstrate that whereas the current an anode can conduct increases proportionally to the nickel content in the alloy, the workability decreases seriously with a nickel content in excess of 10 percent.

Table 2 summarizes the results of tests on the amounts of current that could be carried by anodes in which the nickel concentration was fixed to 3 percent but which were heat-treated under varying conditions. The test specimens "as hot-rolled" 1 and hot-rolled and then heat-treated at temperatures below 400° or above 800° C., 2, 3, and 7, were all rated "x ". The anodes made by heat treatment in accordance with the invention, 4, 5, and 6, were all "O".

It will be seen from Tables 1 and 2 that the method of the invention for producing anodes is very effective.

TABLE 1

Time periods required for bath voltage rise with varied nickel contents in titanium

| Composition | Current density (A/dm$^2$) 1.0 | 1.2 | 1.4 | 1.6 | 1.8 | Workability |
|---|---|---|---|---|---|---|
| Pure titanium | o | x | x | x | x | good |
| Ti-0, 0.5% Ni | o | x | x | x | x | good |
| Ti-0, 1% Ni | o | Δ | x | x | x | good |
| Ti-1% Ni | o | o | Δ | x | x | good |
| Ti-3% Ni | o | o | o | o | x | good |
| Ti-5% Ni | o | o | o | o | Δ | not bad |
| Ti-10% Ni | o | o | o | o | o | not bad |
| Ti-12% Ni | o | o | o | o | o | very bad |

0 = The bath boltage did not exceed 7 V for 100 hrs or longer
Δ = The bath voltage exceeded 7 V in 50–100 hrs
x = The bath voltage exceeded 7 V within 50 hrs

TABLE 2

Time periods required for bath voltage rise with varied heat treatment conditions

| Manufacturing conditions* | Current density (A/dm$^2$) 1.0 | 1.2 | 1.4 | 1.6 | 1.8 | Remarks |
|---|---|---|---|---|---|---|
| Pure titanium | o | x | x | x | x | Comp. Ex. |
| ① | o | o | x | x | x | Comp. Ex. |
| ② | o | o | x | x | x | Comp. Ex. |
| ③ | o | o | x | x | x | Comp. Ex. |
| ④ | o | o | o | Δ | x | Invention |
| ⑤ | o | o | o | o | x | Invention |
| ⑥ | o | o | o | o | Δ | Invention |

TABLE 2-continued

Time periods required for bath voltage rise with varied heat treatment conditions

| Manufacturing conditions* | Current density (A/dm$^2$) 1.0 | 1.2 | 1.4 | 1.6 | 1.8 | Remarks |
|---|---|---|---|---|---|---|
| ⑦ | o | o | x | x | x | Comp. Ex. |

①Ti-3% Ni→ forged (900° C.)→ hot-rolled (950° C.)→ anode.
②Ti-3% Ni→ forged (900° C.)→ hot-rolled (950° C.)→ heat-treated (150° C. for 48 hrs)→ anode.
③Ti-3% Ni→ forged (900° C.)→ hot-rolled (950° C.)→ heat-treated (300° C. for 48 hrs)→ anode.
④Ti-3% Ni→ forged (900° C.)→ hot-rolled (950° C.)→ heat-treated (400° C. for 48 hrs)→ anode.
⑤Ti-3% Ni→ forged (900° C.)→ hot-rolled (950° C.)→ heat-treated (600° C. for 3 hrs)→ anode.
⑥Ti-3% Ni→ forged (900° C.)→ hot-rolled (950° C.)→ heat-treated (730° C. for 3 hrs)→ anode.
⑦Ti-3% Ni→ forged (900° C.)→ hot-rolled (950° C.)→ heat-treated (900° C. for 3 hrs)→ anode.
o = The bath voltage did not exceed 7 V for 100 hrs or longer.
Δ = The bath voltage exceeded 7 V in 50–100 hrs.
x = The bath voltage exceeded 7 V within 50 hrs.

Table 3 shows the results of tests on the amounts of current that could be carried by anodes cold-rolled prior to heat treatment at 400°–800° C. It is clear that the anodes cold-rolled to a reduction of 10% or more before the heat treatment could conduct more current than those not so cold-rolled.

Table 4 compares test specimens having varied surface roughnesses in respect of the adhesion of electrolytic manganese dioxide deposited thereon. It will be understood that manganese dioxide does not adhere soundly to the surface unless the latter has a roughness of at least 100 μm.

The manganese dioxide produced using the electrode according to the method of the invention has been confirmed to be excellent in quality. The electrode made by the method of the invention offers the advantage that when it is used in the electrolysis for the production of manganese dioxide it permits the use of a high current density. Another advantage is that, the current density being the same, it could use a lower bath voltage than a conventional pure titanium electrode.

TABLE 3

Time periods required for bath voltage rise with varied heat treatment conditions

| Manufacturing conditions* | Current density (A/dm$^2$) 1.0 | 1.2 | 1.4 | 1.6 | 1.8 | 2.0 |
|---|---|---|---|---|---|---|
| Pure titanium | o | x | x | x | x | x |
| ① | o | o | o | o | Δ | x |
| ② | o | o | o | o | Δ | x |
| ③ | o | o | o | o | Δ | x |
| ④ | o | o | o | o | o | x |
| ⑤ | o | o | o | o | o | Δ |
| ⑥ | o | o | o | o | o | Δ |

①Ti-3% Ni→ forged (900° C.)→ hot-rolled (950° C.)→ anode.
②Ti-3% Ni→ forged (900° C.)→ hot-rolled (950° C.)→ heat-treated (730° C. for 3 hrs)→ anode.
③Ti-3% Ni→ forged (900° C.)→ hot-rolled (950° C.)→ 5% cold-rolled→ heat-treated (730° C. for 3 hrs)→ anode.
④Ti-3% Ni→ forged (900° C.)→ hot-rolled (950° C.)→ 10% cold-rolled→ heat-treated (730° C. for 3 hrs)→ anode.
⑤Ti-3% Ni→ forged (900° C.)→ hot-rolled (950° C.)→ 30% cold-rolled→ heat-treated (730° C. for 3 hrs)→ anode.
⑥Ti-3% Ni→ forged (900° C.)→ hot-rolled (950° C.)→ 50% cold-rolled→ heat-treated (730° C. for 3 hrs)→ anode.
o = The bath voltage did not exceed 7 V for 100 hrs or longer.
Δ = The bath voltage exceeded 7 V in 50–100 hrs.
x = The bath voltage exceeded 7 V within 50 hrs.

TABLE 4

| Conditions of manganese dioxide deposition | |
|---|---|
| Anode surface roughness (Rmax) | Adhesion |
| As rolled | Exfoliation |
| 22 μm | Exfoliation |
| 83 μm | Exfoliation |
| 106 μm | Adhesion |
| 325 μm | Good adhesion |
| 981 μm | Good adhesion |

Thus the present invention provides anode materials which permit the flow of by far the larger amounts of current than pure titanium does, and which are more resistant to corrosive attacks. The method of the invention which produces such anode materials with very great electrode characteristics is most effective in producing anode materials for industrial applications, typically for the production of electrolytic manganese dioxide.

What is claimed is:

1. A method of producing an anode material for electrolytic use which comprises heat-treating a titanium alloy which consists of from 0.1 to 10 percent by weight of nickel and the remainder of titanium and unavoidable impurities and which has been thermally affected above the beta transformation point thereof, at a temperature between 400° and 800° C.

2. A method according to claim 1 wherein the anode material is finished to have a surface roughness, Rmax, of at least 100 μm.

3. A method according to claim 1 wherein the anode material is made to have a yield strength of at least 30 kgf/mm$^2$ and a Vickers hardness of at least 150.

4. A method according to claim 1 wherein the anode material is finished to have a flatness of at most 6 mm per meter.

5. A method of producing an anode material for electrolytic use which comprises cold-working a titanium alloy which consists of from 0.1 to 10 percent by weight of nickel and the remainder of titanium and unavoidable impurities and which has been thermally affected above the beta transformation point thereof, to a working degree of 10 percent and subsequently heat-treating the same at a temperature between 400° and 800° C.

6. A method according to claim 5 wherein the anode material is finished to have a surface roughness, Rmax, of at least 100 μm.

7. A method according to claim 5 wherein the anode material is made to have a yield strength of at least 30 kgf/mm$^2$ and a Vickers hardness of at least 150.

8. A method according to claim 5 wherein the anode material is finished to have a flatness of at most 6 mm per meter.

* * * * *